US005825341A

United States Patent [19]

Pawlowski

[11] Patent Number: 5,825,341

[45] Date of Patent: Oct. 20, 1998

[54] CONTROL INTERFACE FOR LCD DOT MATRIX DISPLAYS AND METHOD OF OPERATING THE SAME

[75] Inventor: Wojciech Pawlowski, Germantown, Tenn.

[73] Assignee: International Telecommunication Corp., Memphis, Tenn.

[21] Appl. No.: 788,829

[22] Filed: Nov. 7, 1991

[51] Int. Cl.[6] ..... G09G 3/36

[52] U.S. Cl. ..... 345/87; 345/59; 345/98

[58] Field of Search ..... 340/784, 765, 340/717, 762, 811, 798, 799, 766; 345/87, 90, 98, 55, 59, 211, 38, 50, 51

[56] References Cited

U.S. PATENT DOCUMENTS 4,262,292 4/1981 Duley ..... 340/762

5,119,083 6/1992 Fujisawa et al. ..... 340/784

FOREIGN PATENT DOCUMENTS 56-116188 9/1981 Japan .

*Primary Examiner*—Dennis-Doon Chow

*Attorney, Agent, or Firm*—Ware, Fressola, Van Der Sluys & Adolphson LLP

[57] ABSTRACT

A control interface for a liquid crystal display having more than 80 characters uses a pair of controller/driver devices each having inputs for eight data bits but being adaptable to operate with four data bits from a 4-bit microprocessor. A standard 8-bit microprocessor is used to control the controller/driver devices by connecting the four bits of a low data nibble of the microprocessor to the four high data bits of one controller/driver and four bits of a high data nibble of the microprocessor to the four high data bits of the other controller/driver. The control interface can interface to liquid crystal displays with less than 80 characters without microprocessor modification.

23 Claims, 4 Drawing Sheets

CONTROL INTERFACE FOR LCD DOT MATRIX DISPLAYS AND METHOD OF OPERATING THE SAME

BACKGROUND OF THE INVENTION

1. Field of the Invention

The present invention relates to liquid crystal displays, and more particularly to a control interface and method that will allow one type of microprocessor to drive displays of different size.

2. Description of the Prior Art

The use of liquid crystal displays (LCDs) is becoming more common in many different types of consumer products. The LCD uses a controller/driver to control and drive the desired information on the LCD. As seen in FIG. 1, a typical controller/driver has sixteen row (common) drivers (COM 1 to COM 16) and forty segment drivers (SEG 1 to SEG 40).

In a particular type of product, the size of the display used may vary with the features provided on a particular model of the product. For example, low-end models may utilize displays having up to 80 characters formed in two lines of 40 characters each, which are commonly referred to as 40×2 displays. The high-end models may require 160 characters, which are provided in a display having four lines of 40 characters each, better known as a 40×4 display. FIG. 2 illustrates a 40×4 LCD dot matrix display, wherein the display has the capacity for four lines, each line having a maximum of 40 characters, with each character using a 5×7 dots character font. A 40×2 display would look similar to the display in FIG. 2 but would show only two lines of characters.

The controller driver alone can drive a maximum of 16 characters. It can be programmed to work in the following modes:

a. 5×7 dots character font arranged in two lines of 8 characters each (FIG. 1).

b. 5×7 dots character font arranged in one line of 8 characters.

c. 5×10 dots character font arranged in one line of 8 characters.

It is common practice for LCDs to be mounted in a liquid crystal display module, or LCD module, with the module including the necessary drive components. Referring to FIG. 3, there is shown a typical LCD module 10 using an 80-character 40×2 LCD 12 driven in part by LCD segment drivers 14 and controlled by a controller/driver 16. LCD 12 is a standard LCD, such as those manufactured by Hitachi Corporation. The segment drivers 14 may be those manufactured by Hitachi, such as Model No. HD 44100, or equivalents thereto (Model MSM 5259 manufactured by OKI, and Model KS0065 manufactured by Samsung). Driver 14' is shown dotted to illustrate this expansion possibility. Each segment driver can drive a maximum of sixteen characters. Thus, depending on the number of segment drivers used, the LCD module can have the following configurations:

a. 2 lines×16 characters (1 segment driver used).

b. 2 lines×40 characters (4 segment drivers used.

c. 1 line×80 characters (9 segment drivers used).

d. any other configuration, provided the total number of characters will not exceed 80.

The controller/driver used in most present-day LCD modules is a Model HD44780 Controller/Driver manufactured by Hitachi and equivalents thereto (Model MSM 6222B-01, manufactured by OKI; Model KS-0066, manufactured by Samsung; and Model SED 1278F, manufactured by S-MOS). The controller/driver 16 interfaces with a microprocessor unit (MPU) 18, which in FIG. 2 is shown as an 8-bit MPU.

The Hitachi HD44780 has become the standard controller/driver in the industry and is adapted to interface with either 4-bit or 8-bit MPUs and is therefore an extremely versatile unit. When the HD44780 controller/driver is interfaced with a 4-bit MPU, only data bits 4–7 of the controller/driver input are connected to the MPU, and the MPU operates in a two-step mode, with the higher order four bits, namely DB4–DB7 being transferred first, and then the lower order four bits, namely DB0–DB3 being transferred second. In this configuration, the enable signal E can be generated by one of the input/output (I/O) pins of the MPU, or if not enough MPU pins are available, the E signal is generated by using additional control logic (not shown).

Referring to FIG. 4, there is shown an LCD module 20 including an LCD 22 which is a 160-character display of the 40×4 type, as shown in FIG. 1. The LCD display 22 may be similar to the standard 40×4 displays, such as Samsung Model SMC4040A, or Stanley Model GMD40421. The module 20 also includes the usual complement of four segment drivers 24 on each side of display 22, which may be similar to the Hitachi Model HD 44100 or the OKI Model MSM 5259.

When the LCD 22 exceeds an 80-character display, it is required that two controller/drivers 26 be utilized, as shown in FIG. 4. The controller drivers in this case are also the standard Hitachi HD44780 controller/drivers, as used in FIG. 3. The controller drivers are controlled by an MPU 28, which is an 8-bit MPU having eight data outputs DB0–DB7 connected in parallel to the eight data inputs of both controller/drivers 26. The read/write and register selection (Rs) outputs are also connected in parallel to the controller drivers 26. However, separate enable signals E1, E2 must be provided for each of the two controller drivers 26. The enable signals E1 and E2 can be generated by separate MPU I/O pins, or if not enough MPU pins are available, the enable signals are generated by using additional control logic. Thus, the control hardware essentially differs from the control hardware used in FIG. 3 and therefore a standard unified hardware cannot be used with LCD modules of differing sizes.

In a particular consumer product, if a model requires a larger LCD than another model, additional hardware, or in some cases, a different MPU must be provided. The need for different hardware makes the support of different size displays more difficult and increases inventory requirements and costs. This support problem may be particularly difficult if a product is designed to support a smaller display and there is a need to support a larger display without introducing hardware modifications. The present invention overcomes these support problems.

SUMMARY OF THE INVENTION

The present invention contemplates an MPU-controller driver interface arrangement and method which allows the same hardware to be used with LCD modules using one controller/driver or two controller/drivers. The invention utilizes the standard Hitachi HD44780 controller/driver, but uniquely uses the device in its second operational mode, which is adapted for use with a 4-bit MPU. A standard 8-bit MPU is used to simultaneously drive two controller/driver devices. A low data nibble of the MPU consisting of four bits is connected to one controller/driver, and a 4-bit high data nibble is connected to the other controller/driver. In each case the four bits are connected to the data inputs D4–D7 of each controller/driver.

It is a primary objective of the present invention to provide unified hardware that may be used to drive LCD dot matrix displays having 80 or less characters and displays having more than 80 characters.

It is another objective of the present invention to reduce the inventory requirements for additional hardware by providing a single circuit that may be used to drive one or more controller/drivers.

DESCRIPTION OF THE PREFERRED EMBODIMENT

Figure 1:
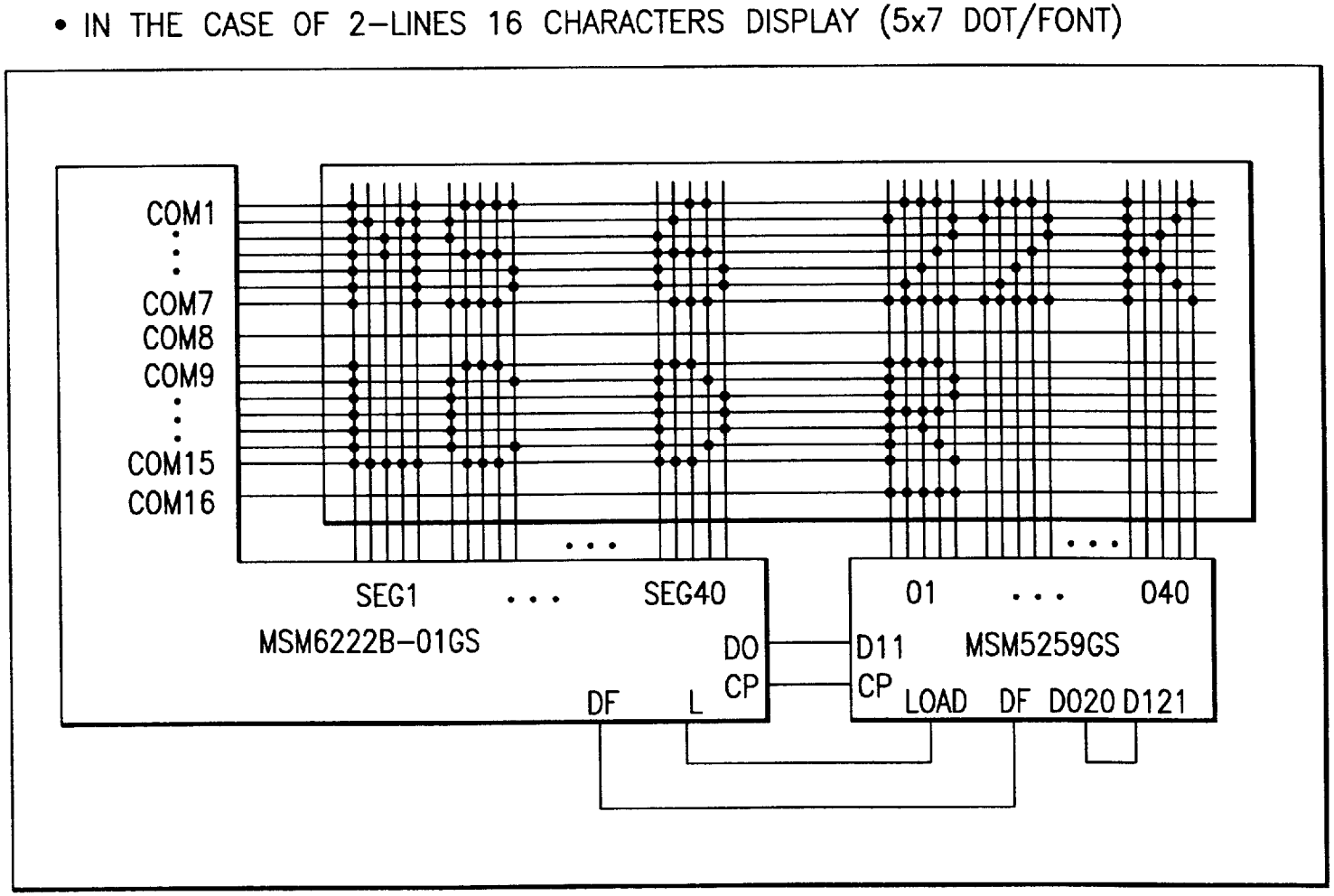
FIG. 1 (PRIOR ART)
FIG. 1 is a diagrammatic schematic view of an LCD display comprising sixteen characters and driven by one controller/driver. The LCD is shown displaying two lines, each using a 5×7 dot font.
Figure 2:
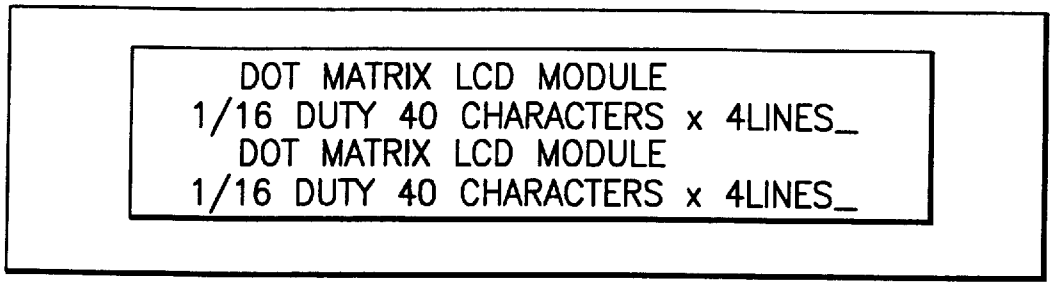
FIG.2 (PRIOR ART)
FIG. 2 is a plan view illustrating an LCD display.
Figure 3:
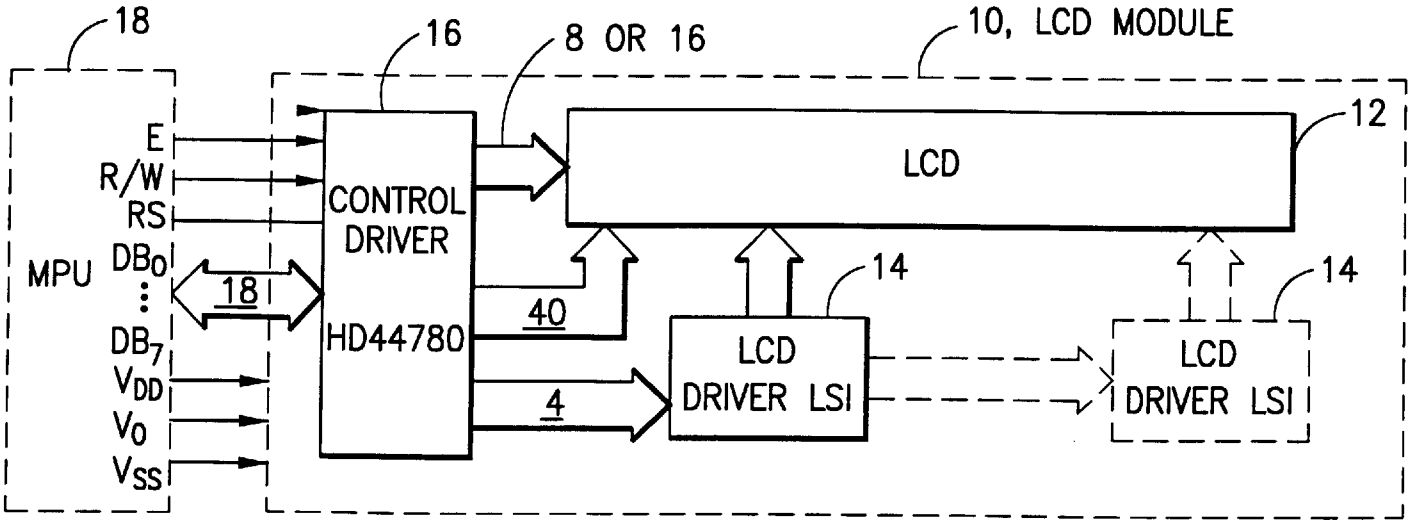
FIG.3 (PRIOR ART)
FIG. 3 is a block diagram of an LCD display using a single controller/driver.
Figure 4:
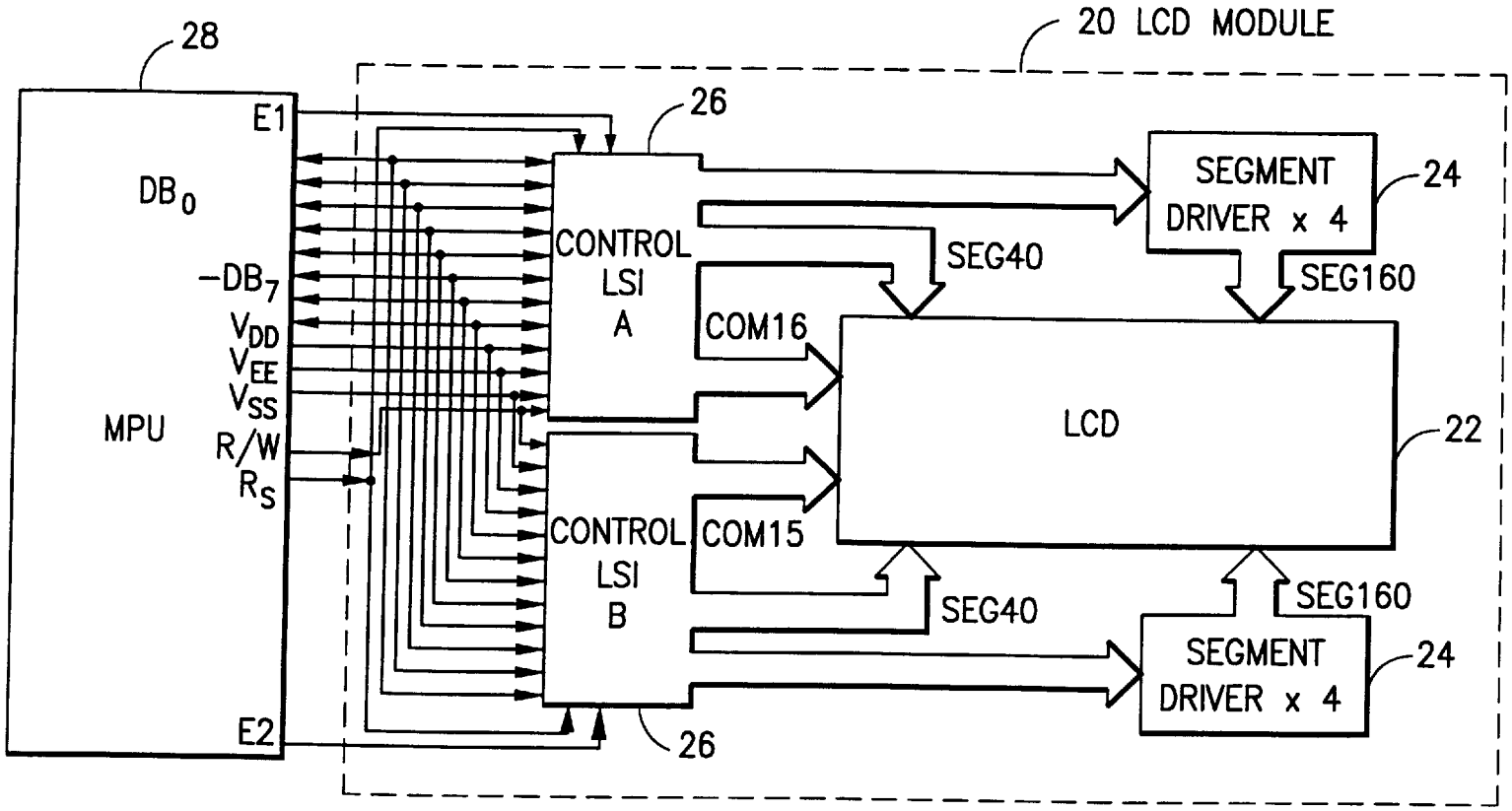
FIG. 4 (PRIOR ART)
FIG. 4 is a block diagram of an LCD display utilizing dual controller/drivers.
Figure 5:
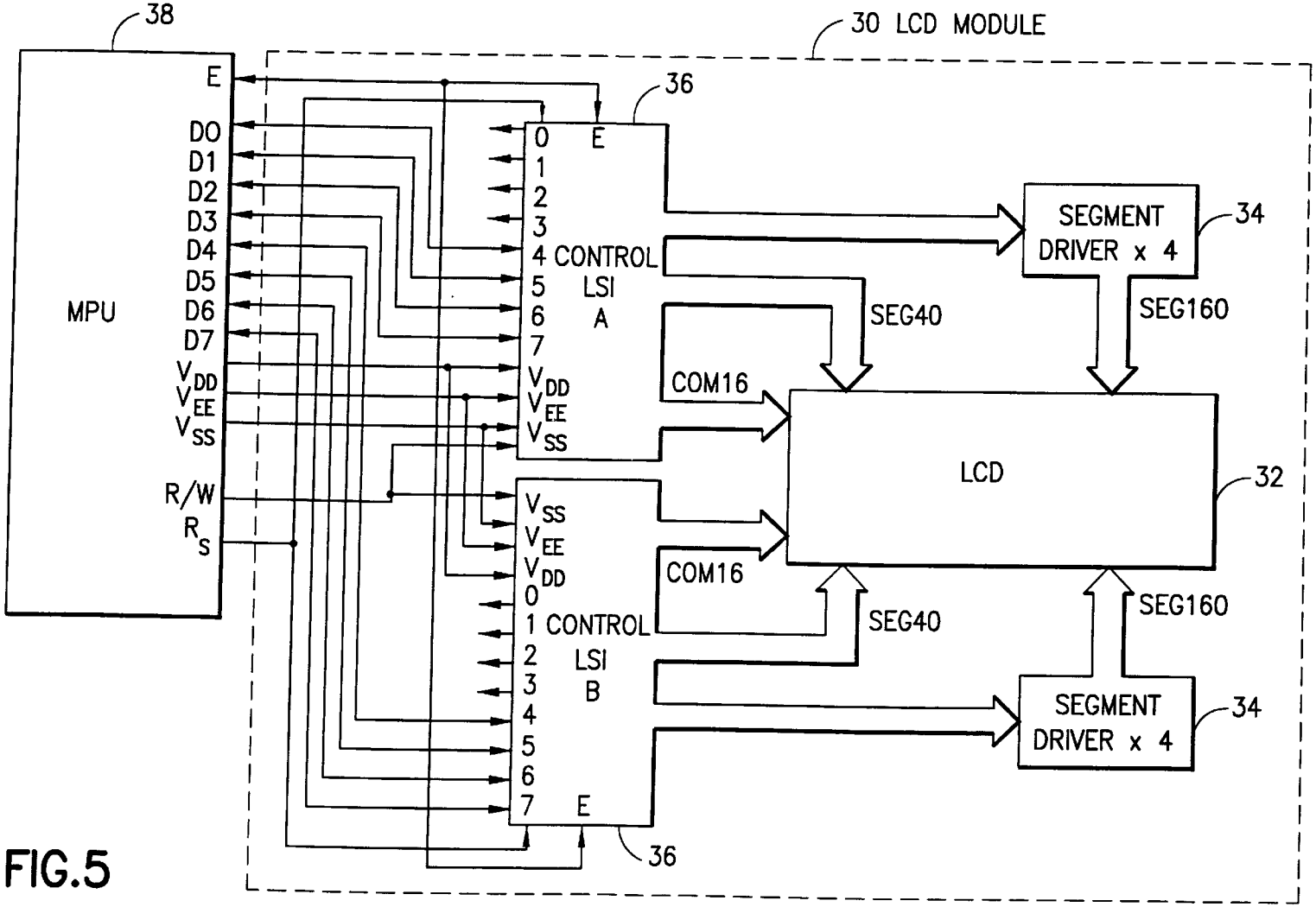
FIG. 5 is a block diagram of an LCD display constructed in accordance with the present invention.

Referring to FIG. 5, there is shown an LCD module 30 including an LCD 32 which is of the 40×4 type for displaying up to 160 characters. The LCD 32 is driven by controller/drivers 36 and associated segment drivers 34. The LCD 32 and the segment drivers 34 are controlled by a pair of controller/drivers 36. The controller drivers are the standard Hitachi HD44780 controller/drivers but are operated in the second mode designed for connection to a 4-bit MPU. However, the controller drivers 36 are connected to a standard 8-bit MPU 38 identical to that which is used in FIG. 3, with a smaller LCD having 80 or less characters. Enable (E), register select (Rs) and read/write (R/W) outputs of the MPU are all connected in parallel to both controller/drivers 36. However, the data outputs D0–D7 of MPU 38 are uniquely connected such that the low data nibble consisting of four data bits, namely D0–D3, are connected to the D4–D7 inputs of one controller/driver 36, while the high data nibble of the MPU 38, consisting of data bits D4–D7, are connected to the D4–D7 inputs of the other controller driver 36.

The MPU 38 is programmed to operate in a two-step transfer mode, first outputting the lower four bits of an 8-bit signal and then the upper four bits. The controller/drivers 36 in the second mode of operation are adapted to receive this two-step transfer of data. More particularly, the MPU program includes an initialization procedure to automatically recognize the type of LCD display used, namely, up to 80 characters (a single controller driver) or more than 80 characters (two controller drivers).

The initialization procedure assumes by default that there are two controller/drivers connected, namely, a first controller/driver connected to the upper data nibble (data lines D7 to D4), and a second controller/driver connected to the lower data nibble (data lines D3 to D0). In order to initialize both controller/drivers, the identical bit pattern is generated by the MPU on higher nibble and on lower nibble. The bit patterns required to initialize the controller/driver into a 4-bit operation are specified in the Hitachi user's manual for the HD 44780 controller/driver.

If the LCD display uses two controller/drivers sharing the split data bus, then each controller is initialized into a 4-bit operation and utilizes its portion of the data bus.

If the LCD display uses one controller/driver connected to the full data bus, the controller is initialized into a 4-bit operation and utilizes an upper nibble of the data bus while ignoring the lower four bits.

To verify if the LCD display uses one or two controller drivers, the MPU attempts to write data to the display data RAM (DD RAM) of both controller/drivers and then attempts to read the data back. Both the write and then the read operations are attempted using upper and lower nibbles, assuming that the upper nibble is used to access one controller/driver and the lower nibble is used to access the other controller/driver.

If the written data can be read back correctly via both upper and lower nibbles, the LCD display uses two controller/drivers. If the written data can be read back correctly only via the upper nibble, the LCD display uses only one controller/driver.

Programming a Dual Controller/Driver Interface

Having all control lines of both controller/drivers in parallel means that every read or write access of the MPU affects both controller/drivers concurrently. The following technique is used in order to be able to control both chips independently:

1. When writing an instruction to the instruction register (IR) of one controller/driver, an undefined instruction code is written to the IR of the other controller/driver. The undefined instruction code has all data bits equal to zero. When the undefined instruction code is loaded into the other controller/driver, it accepts the code but does not change its internal states.
2. When writing an instruction to set the DD RAM address in the address counter (AC) of one controller/driver, an undefined address is written to the AC of the other controller driver. The undefined address is a DD RAM address which is not mapped into any position on the liquid crystal display. More particularly, the display data RAM (DD RAM) stores display data represented in 8-bit character codes. There is a relation between DD RAM addresses and positions on the liquid crystal display. In a 2-line display mode, for example, the DD RAM address 0 to 27 (hex) is mapped to the 1 to 40 display position of the first line, the DD RAM address 40 to 67 (hex) is mapped to the 1 to 40 display position of the second line (see Table 1). The remaining DD RAM addresses 29 to 39 (hex) and 68 to 7F (hex) are considered undefined. When any undefined address is loaded into the AC, it is impossible to make a normal write/read of character codes to and from the DD RAM. In this way, it is possible to modify the DD RAM of one controller/driver without affecting the DD RAM of the other controller/driver.

TABLE 1

| | 1 | 2 | 3 | 4 | 5 | 6 | 7 | 8 | 9 | 10 | 11 | 12 | 13 | 14 | 15 | 16 | 17 | 18 | 19 | 20 | | 33 | 34 | 35 | 36 | 37 | 38 | 39 | 40 | display position |
|---|---|---|---|---|---|---|---|---|---|---|---|---|---|---|---|---|---|---|---|---|---|---|---|---|---|---|---|---|---|---|
| 1-line | 00 | 01 | 02 | 03 | 04 | 05 | 06 | 07 | 08 | 09 | 0A | 0B | 0C | 0D | 0E | 0F | 10 | 11 | 12 | 13 | ..... | 20 | 21 | 22 | 23 | 24 | 25 | 26 | 27 | DD RAM address (HEX) |
| 2-line | 40 | 41 | 42 | 43 | 44 | 45 | 46 | 47 | 48 | 49 | 4A | 4B | 4C | 4D | 4E | 4F | 50 | 51 | 52 | 53 | ..... | 60 | 61 | 62 | 63 | 64 | 65 | 66 | 67 | |
| | HD44780 display | | | | | | | | HD44100 (1) display | | | | | | | HD44100H (2) (3) display | | | | | | HD44100H (4) | | | | | | | | |

Thus, by uniquely using the Hitachi HD44780 controller/driver in either a 4-bit or an 8-bit input mode, the same MPU 38 may be used to control a single controller/driver for operating an LCD with 80 or less characters or may be used to control two controller/drivers for operating an LCD having more than 80 characters. Accordingly, the present invention provides a single MPU that may be used to drive either small or large LCDs. A significant advantage of the interface arrangement is that support for both smaller and larger LCD displays is less difficult, and no additional hardware is required.

What is claimed is:

1. A control interface for a liquid crystal display, said interface comprising:

a pair of control devices connected to the liquid crystal display for controlling the same, each said control device having a 4-bit microprocessor mode; and an 8-bit microprocessor for simultaneously controlling the pair of control devices, said microprocessor having eight data bit outputs, with its four lowest data bits of the microprocessor only being connected to one control device, and with its four highest data bits only being connected to the other control device.

2. A control interface as described in claim 1, wherein the liquid crystal display displays more than 80 characters and wherein each of the control devices includes segment drivers for driving a portion of the characters displayable by the liquid crystal display.

3. A control interface as described in claim 2, wherein the liquid crystal displays four lines each having 40 characters.

4. A control interface as described in claim 1, comprising enable control means for generating an enable control signal, and being connected in parallel to the pair of control devices.

5. A control interface as described in claim 4, wherein said microprocessor generates the enable control signal.

6. A control interface as described in claim 1, wherein each of said control devices can operate in an 8-bit microprocessor mode and a 4-bit microprocessor mode.

7. A control interface as described in claim 6, wherein each of said control devices includes eight data bit inputs for receiving eight data bits from an 8-bit microprocessor when operating in the 8-bit microprocessor mode, and for receiving four data bits at the four highest data bit inputs when operating in the 4-bit microprocessor mode.

8. A control interface as described in claim 7, wherein the control devices are Hitachi HD44780 controller/drivers or equivalent controller/drivers.

9. A control interface as described in claim 7, wherein the control device, when operating in the 4-bit microprocessor mode, receives from the microprocessor 8-bit data in a two-step transfer mode transferring four bits in each step.

10. A liquid crystal display device, comprising:

a liquid crystal display;

LCD driver means for driving said liquid crystal display;

a pair of LCD control devices connected to said driver means and said liquid crystal display for controlling the same, each said LCD control device by a 4-bit microprocessor mode; and an 8-bit microprocessor for simultaneously controlling the pair of LCD control devices, said microprocessor having eight data bit outputs, with its four lowest data bits only being connected to one LCD control device, and with its four highest data bits only being connected to the other LCD control device.

11. A liquid crystal display device as described in claim 10, wherein the liquid crystal display displays four lines each having 80 characters.

12. A liquid crystal display device as described in claim 11, wherein the liquid crystal display displays four lines each having 40 characters.

13. A liquid crystal display device as described in claim 10, comprising means for providing an enable control output signal, and being connected in parallel to the control devices.

14. A liquid crystal display device as described in claim 13, wherein said microprocessor generates the enable control signal.

15. A liquid crystal display device as describe in claim 10, wherein each of said control devices can operate in an 8-bit microprocessor mode and a 4-bit microprocessor mode.

16. A liquid crystal display device as described in claim 15, wherein each of said control devices includes eight data bit inputs for receiving eight data bits from an 8-bit microprocessor when operating in the 8-bit microprocessor mode, and for receiving four data bits at the four highest data bit inputs when operating in the 4-bit microprocessor mode.

17. A liquid crystal display device as described in claim 16, wherein the control devices are Hitachi HD44780 controller/drivers or equivalent controller/drivers.

18. A liquid crystal display device as described in claim 16, wherein the control device, when operating in the 4-bit microprocessor mode, receives from the microprocessor 8-bit data in a two-step transfer mode transferring four bits in each step.

19. A liquid crystal display device as described in claim 18, wherein the control devices are a portion of the driver means, with the remaining portion of the driver means comprising segment drivers.

20. A liquid crystal display device as described in claim 10, wherein the control devices are a portion of the driver means, with the remaining portion of the driver means comprising segment drivers.

21. A method of controlling a liquid crystal display device including a liquid crystal display for displaying more than 80 characters, a pair of controller/drivers for controlling and driving the display, said controller/drivers having an eight-bit or a four-bit microprocessor mode and an eight-bit microprocessor for simultaneously controlling said controller/drivers, said method comprising the steps of:

setting said controller/drivers in a four-bit microprocessor mode for processing four bits of data at a time;

providing only a lowest four bits from the eight-bit microprocessor to one controller/driver;

providing only a highest four bits from the eight-bit microprocessor to the other controller/driver; and operating the eight-bit microprocessor in a two-step sequential transfer mode to transfer eight control bits per controller/driver in four bits each step, whereby the controller/drivers each receive eight control bits.

22. A method as described in claim 21, wherein the controller/drivers each have inputs for eight data bits and the four bits provided to the controller/drivers are provided to the highest four data bit inputs of each controller/driver.

23. A control interface for a liquid crystal display, said interface comprising:

a pair of LCD control devices connected to the liquid crystal display for controlling the same, each said LCD control device having an n-bit microprocessor mode; and a 2 n-bit microprocessor for simultaneously controlling the pair of LCD control devices, the 2 n-bit microprocessor having 2 n data bit outputs, with its n lowest data bits of the microprocessor only being connected to one LCD control device, and with its n highest data bits only being connected to the other LCD control device.

* * * * *